US007014420B2

(12) United States Patent
Chang

(10) Patent No.: US 7,014,420 B2
(45) **Date of Patent: *Mar. 21, 2006**

(54) COMPOSITE HEAT-DISSIPATING SYSTEM AND ITS USED FAN GUARD WITH ADDITIONAL SUPERCHARGING FUNCTION

(75) Inventor: Shun-Chen Chang, Taipei (TW)

(73) Assignee: Delta Electronics Inc., Taoyuan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/644,025

(22) Filed: Aug. 20, 2003

(65) Prior Publication Data

US 2004/0033135 A1 Feb. 19, 2004

Related U.S. Application Data

(63) Continuation of application No. 10/060,299, filed on Feb. 1, 2002, now Pat. No. 6,663,342.

(30) Foreign Application Priority Data

Aug. 1, 2001 (TW) ..... 90118816 A

(51) Int. Cl.
*F04D 29/70* (2006.01)

(52) U.S. Cl. ..... 415/121.2; 415/191; 415/199.5; 415/208.2; 415/211.2

(58) Field of Classification Search ..... 415/191, 415/192, 193, 185, 121.2, 199.4, 199.5, 208.2, 415/209.1, 211.2, 215.1, 223; 361/695, 697
See application file for complete search history.

(56) References Cited

U.S. PATENT DOCUMENTS

| | | | | |
|---|---|---|---|---|
| 3,995,970 | A | 12/1976 | Nobuyuki | |
| 4,548,548 | A | 10/1985 | Gray, III | |
| 4,971,143 | A | 11/1990 | Hogan | |
| 6,024,536 | A | 2/2000 | Tsubakida et al. | |
| 6,142,733 | A | 11/2000 | Alizadeh et al. | |
| 6,244,818 | B1 | 6/2001 | Chang | |
| 6,508,621 | B1 * | 1/2003 | Zeighami et al. | 415/119 |
| 6,547,540 | B1 | 4/2003 | Horng et al. | |
| 2002/0094271 | A1 | 7/2002 | Yeuan et al. | |

FOREIGN PATENT DOCUMENTS

CN 1268629 A 10/2000

(Continued)

*Primary Examiner*—Edward K. Look
*Assistant Examiner*—Dwayne J White
(74) *Attorney, Agent, or Firm*—Birch, Stewart, Kolasch & Birch, LLP

(57) ABSTRACT

Disclosed is a composite heat-dissipating system and its used fan guard which can impart a supercharging function to the heat-dissipating fans of the composite heat-dissipating system for efficient heat dissipation and reduces the noise generated when the heat-dissipating fans are operated. The fan guard includes a frame and a set of guard blades arranged inside and fixed onto an inner surface of the frame. The fan guard can be arranged upstream or downstream of the rotor blades of the heat-dissipating fans and assembled with the heat-dissipating fans in series or in parallel to supercharge the airflow out of the heat-dissipating fans.

21 Claims, 12 Drawing Sheets

FOREIGN PATENT DOCUMENTS

| | | | |
|---|---|---|---|
| CN | 2419400 | Y | 2/2001 |
| JP | 6-40318 | U | 5/1994 |
| JP | 8-28491 | A | 1/1996 |
| JP | 2000-257597 | A | 9/2000 |
| JP | 3078820 | U | 4/2001 |
| TW | 487303 | | 5/2002 |
| TW | 488497 | | 5/2002 |
| TW | 523652 | | 3/2003 |

* cited by examiner

COMPOSITE HEAT-DISSIPATING SYSTEM AND ITS USED FAN GUARD WITH ADDITIONAL SUPERCHARGING FUNCTION

This application is a continuation of application Ser. No. 10/060,299, filed on Feb. 1, 2002, now U.S. Pat. No. 6,663,342 the entire contents of which are hereby incorporated by reference and for which priority is claimed under 35 U.S.C. § 120; and this application claims priority of Application Ser. No. 090118816 filed in Taiwan, R.O.C. on Aug. 1, 2001 under 35 U.S.C. § 119.

FIELD OF THE INVENTION

The present invention is related to a composite heat-dissipating system and its used fan guard, and more particularly to a fan guard, adapted to be used with a heat-dissipating device, which imparts a supercharging function to the heat-dissipating device for efficient heat dissipation and reduces the noise generated when the heat-dissipating device is operated.

BACKGROUND OF THE INVENTION

Currently, heat-dissipating fans commonly used in personal computers include an axial-flow fan, a centrifugal fan and a cross-flow fan. Of these, the most popular one is supposed to be an axial-flow fan.

Referring to FIG. 1, a conventional axial-flow fan is primarily consisted of a rotor device 10 and a frame 11 arranged beside the rotor device for supporting the rotor device. The frame 11 includes a motor holder (not shown) and a plurality of ribs 13 arranged between the outer frame 11 and the motor holder. The rotor device 10 includes a motor (not shown) received on the motor holder and a plurality of rotor blades 12 to work on the surrounding air to generate an airflow. Through the work of the rotor blades on the surrounding air, the blast pressure is changed from a relatively low value on the air inlet side into a relatively high value on the air outlet side. That is, there is a blast pressure enhancement on the air outlet side.

Unfortunately, when the airflow flows through the fan having the structure as shown in FIG. 1 and as described above, turbulent flows will be generated after the airflow encounters the ribs so as to have an adverse effect on the blast pressure enhancement. Consequently, the efficiency of the fan is reduced.

In addition, in order to avoid the interruption of operation due to the breakdown of fan used in the heat-generating system, a set of standby fan is usually provided and connected with the original fan in series to prevent the heat-generating system or device from being damaged. Moreover, because the total pressure of the axial-flow fan is relatively low, the axial-flow fan cannot fully develop a high airflow rate in a system of a high resistance. Thus, in the case that a high total pressure is needed, two or more axial-flow fans are connected in series to provide the high total pressure.

Typically, a so-called serial fan is constituted by two independent fan units assembled through a specific circuit design. Each fan unit respectively includes a frame and a rotor device. After these two fan units are assembled respectively, both of them are coupled together through screws (not shown), thereby completing the construction of the serial fan. However, the serial connection of two fan units can not guarantee that the total pressure of the airflow discharged from the fans can be doubled. In other words, even though one fan unit rotates and the other is used as a standby fan, the latter will also decrease the blast pressure discharged from the rotating fan because both of them will be interfered with each other while connected in series, thereby significantly decreasing the overall heat-dissipating efficiency or even generating a lot of noise.

Therefore, it is desirable to develop a heat-dissipating system which can effectively eliminate the interference between the fans assembled together, provide a supercharging function, and reduce the noise generated when the fans are operated.

SUMMARY OF THE INVENTION

Therefore, an object of the present invention is to provide an improved fan guard having a function of supercharging a heat-dissipating fan.

Therefore, another object of the present invention is to provide a composite heat-dissipating system which can effectively eliminate the interference between the heat-dissipating fans assembled together.

Therefore, another yet object of the present invention is to provide a composite heat-dissipating system which can provide a supercharging function and reduce the noise generated when the fans assembled together are operated.

The fan guard essentially includes a frame, and a plurality of guard blades radially arranged inside the frame and fixed onto an inner surface of the frame by each one end thereof. In general, the guard blades are made of plastic. Nevertheless, the guard blades can also be made of a material other than plastic for a desired purpose. For example, they can be made of a metal which is advantageous for heat dissipation.

When assembled with the heat-dissipating device, the frame of the fan guard is coupled to the main frame of the heat-dissipating device. Alternatively, the frame of the fan guard is integrally formed with the frame of the heat-dissipating device so that the fan can be assembled by installing the non-integrally formed parts into the common frame. The fan guard can be arranged either upstream or downstream of the heat-dissipating device. Preferably, the fan guard includes two sets of frame and guard blades respectively arranged by both sides of the heat-dissipating device. By properly designing the shapes and the position arrangement of the guard blades relative to the rotor blades of the heat-dissipating device, the upstream guard blades can guide air into the heat-dissipating device at an angle to make an air inflow to the heat-dissipating device have an additional tangential velocity which increase the work of the rotor blades on air, and on the other hand, the downstream guard blades can transform a tangential velocity of an air outflow from the heat-dissipating device into a static pressure, both advantageous for supercharging the fan. For example, each of the guard blades is made to have a shape identical to those of the rotor blades, but not limited to such a shape. For example, the cross-sectional shape of each guard blade can be plate, triangle, trapezoid or wing, prefereably a cross-sectional shape with a linear central line and one of a curve and an arc. Alternatively, each guard blade has a curved face, an arcuate face, a curve or an arc.

Furthermore, by taking the combination of a fan guard according to the present invention and a heat-dissipating device as a fan unit, a fan can be designed to include a plurality of such fan units to enhance heat-dissipating efficiency. In addition, this constructed fan unit can also be assembled with another fan unit in series or in parallel.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
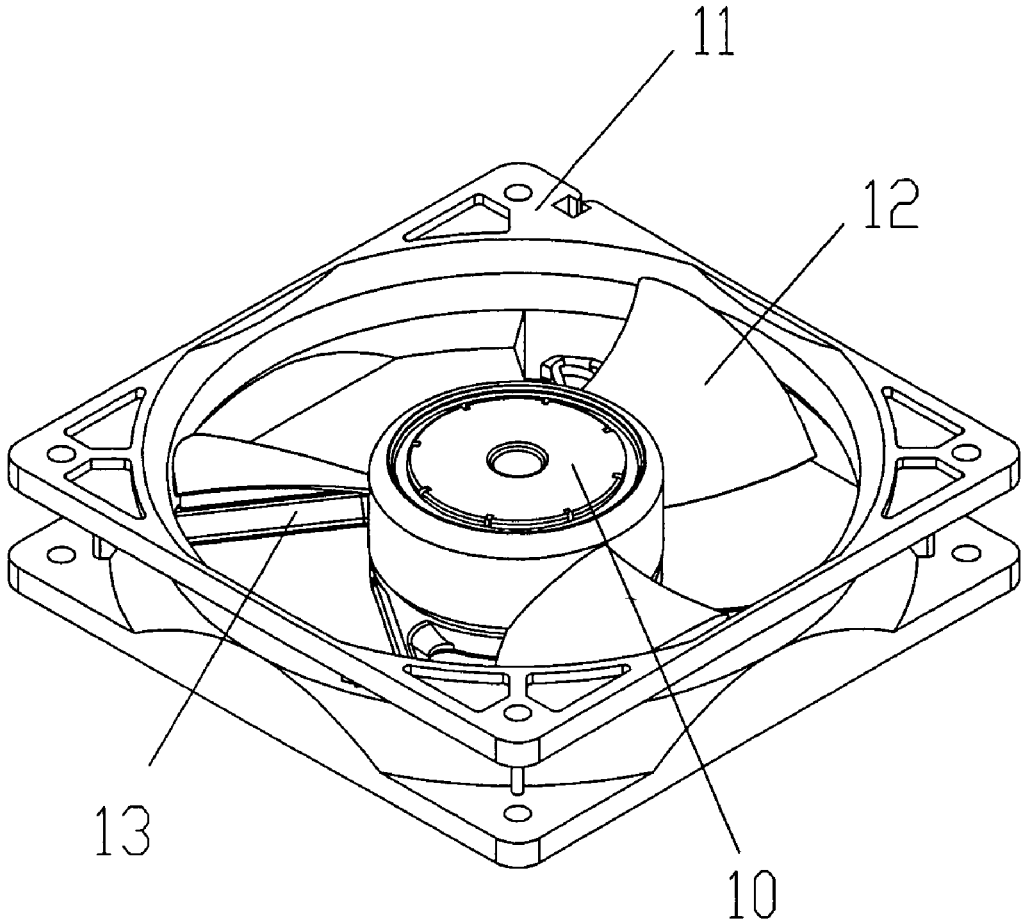
Fig. 1 (Prior Art)
FIG. 1 is a perspective diagram showing a conventional axial-flow fan.
Figure 2:
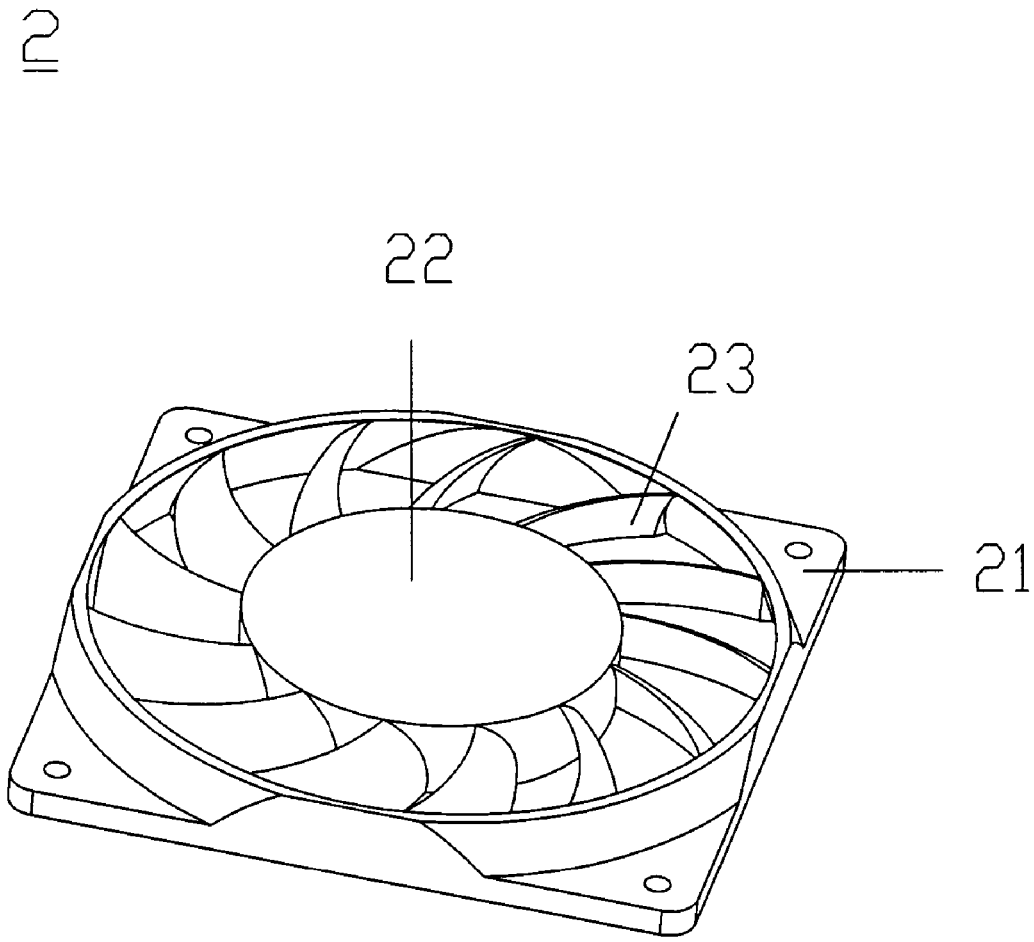
FIG. 2 is a perspective diagram showing a preferred embodiment of the fan guard according to the present invention.

Please refer to FIG. 2 which shows a preferred embodiment of the fan guard of the present invention. The fan guard 2 includes a frame 21, a circular disc 22 and a plurality of guard blades 23 radially disposed within the frame 21. One end of each of the guard blades is fixed onto the inner surface of the frame 21 and the other end thereof is fixed onto the circumferential surface of the circular disc 22. In this embodiment, the frame 21, the circular disc 22 and the plurality of guard blades 23 are integrally formed together.

Figure 3A:
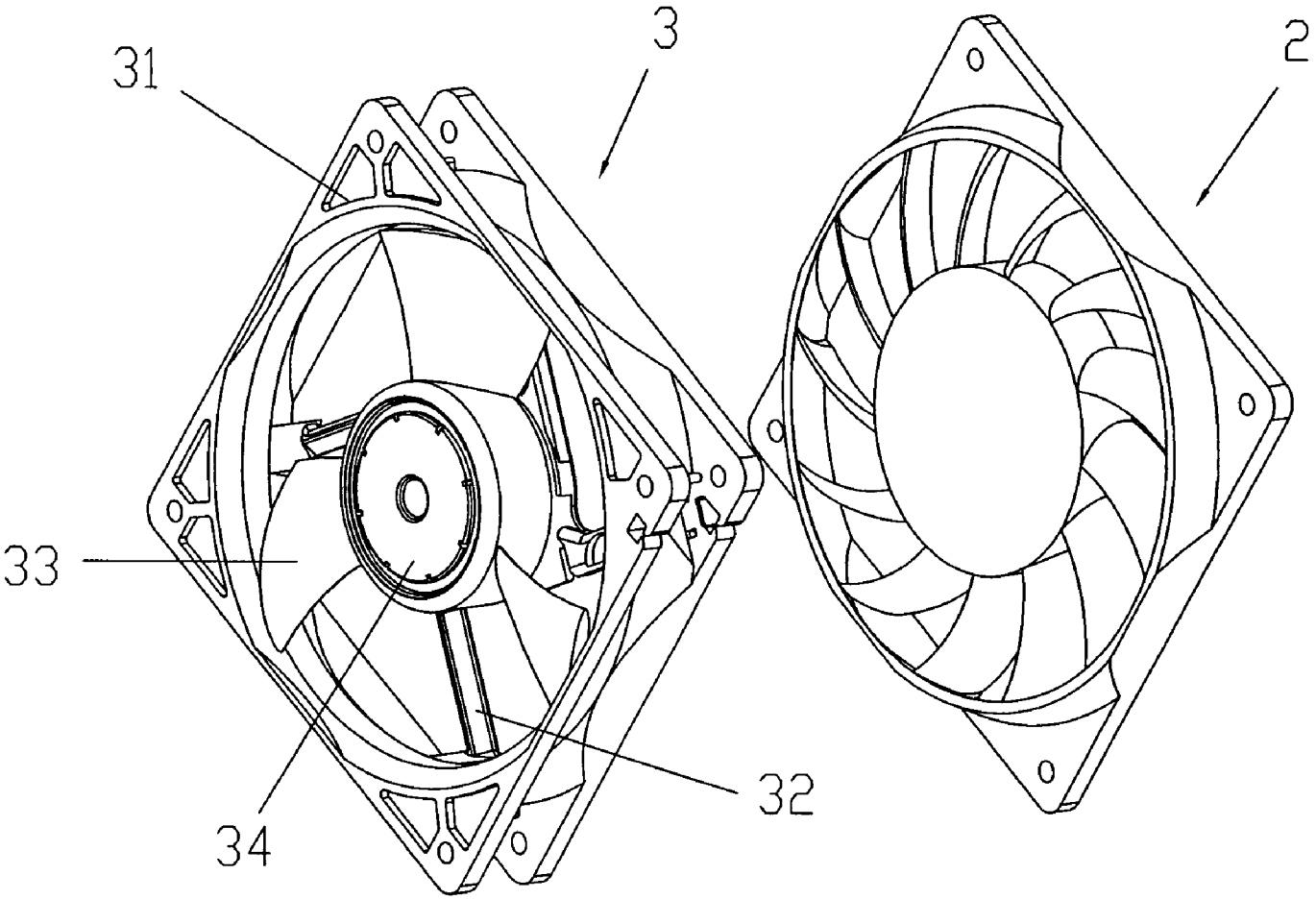
FIG. 3A is an exploded diagram showing a preferred embodiment of a heat-dissipating device constructed by a fan and the fan guard of FIG. 2 according to the present invention.

Please refer to FIG. 3A which schematically shows how a heat-dissipating fan 3 and a preferred embodiment of a fan guard 2 are assembled together. The heat-dissipating device 3 includes a rotor device and a main frame 31 having a plurality of ribs 32. As conventionally used, the rotor device is constructed by a motor (not shown), a shaft ring 34 connected to the motor, and a plurality of rotor blades 33 fixed on the circumferential surface of the shaft ring 34.

Figure 3B:
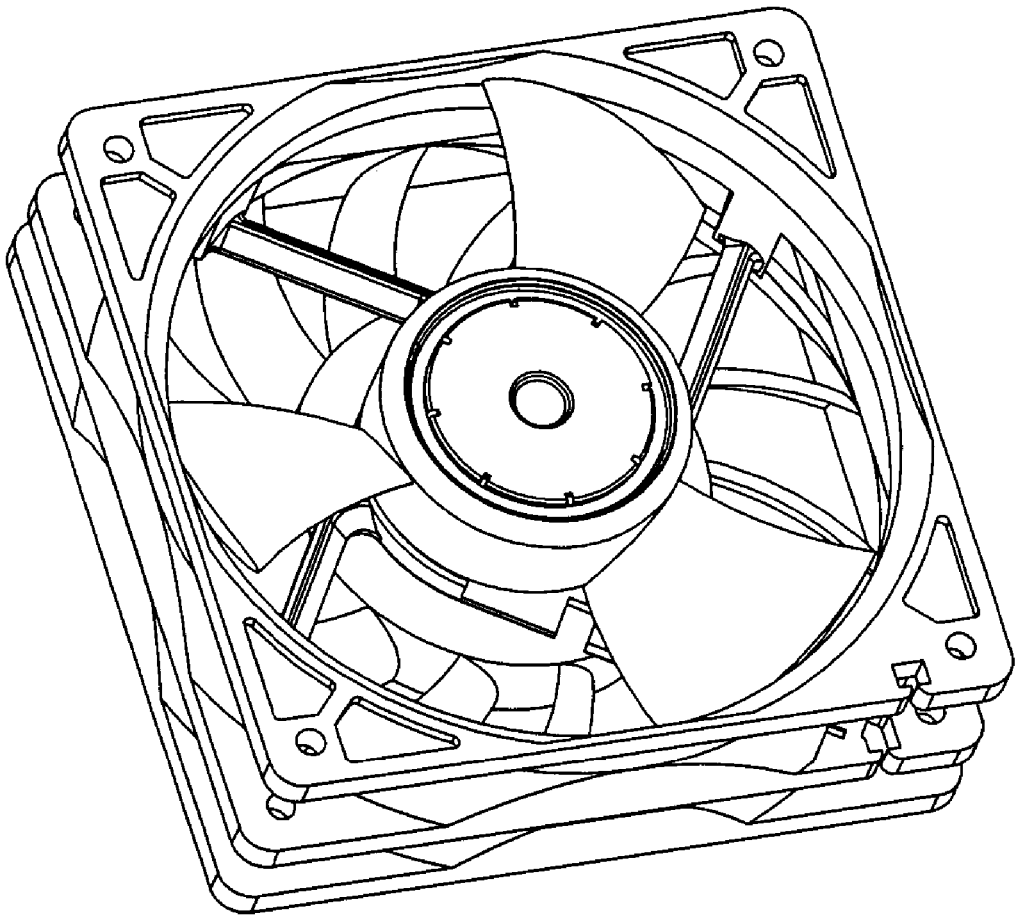
FIG. 3B is a perspective diagram of the assembled heat-dissipating device of FIG. 3A.

The assembly of the heat-dissipating device 3 and the fan guard 2 is shown on FIG. 3B. In this embodiment, the guard blades of the fan guard 2 are located upstream of the heat-dissipating device 3 (i.e. the air inlet side) and have the shapes substantially identical to those of the rotor blades. When the rotor device operates to have the rotor blade revolve, the guard blades guide air into the rotor blade at an angle. Consequently, the air outflow from the guard blade has an axial velocity and a tangential velocity, and thus the airflow arriving at the rotor blade has a tangential velocity. As known, the increase of the tangential velocity enhances the work of the rotor blades on air, so in this way, the fan is supercharged. Alternatively, the guard blades of the fan guard 2 can also be located downstream of the heat-dissipating device 3, that is, the air outlet side. In this case, when the rotor device operates to have the rotor blade revolve at a tangential velocity, the airflow arriving at the guard blade has an axial velocity and a tangential velocity. Due to conservation of mass, the axial velocity will not change through the entire guard blade. The tangential velocity, however, varies from a relatively high value approximating the velocity of the rotor blade to a relatively low value down to zero. According to the Bernoulli's Law, the pressure will increase with the decrease of velocity. The tangential velocity of the airflow through the guard blades will be transformed into a static pressure. Accordingly, the blast pressure further rises through the fan guard and the heat-dissipating device 3 is thus supercharged.

Figure 4A:
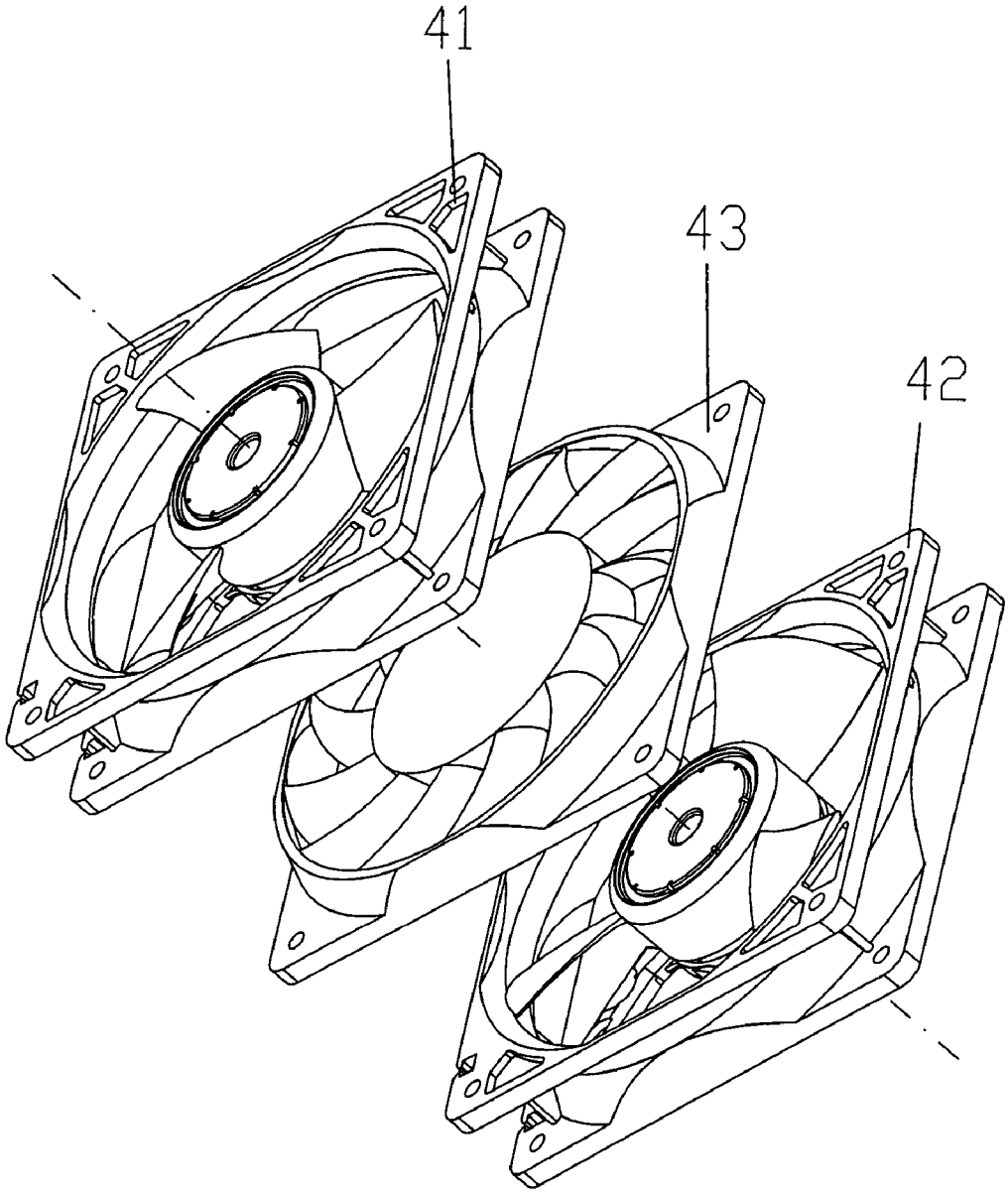
FIG. 4A is an exploded diagram showing a first preferred embodiment of a composite heat-dissipating system according to the present invention.
Figure 4B:
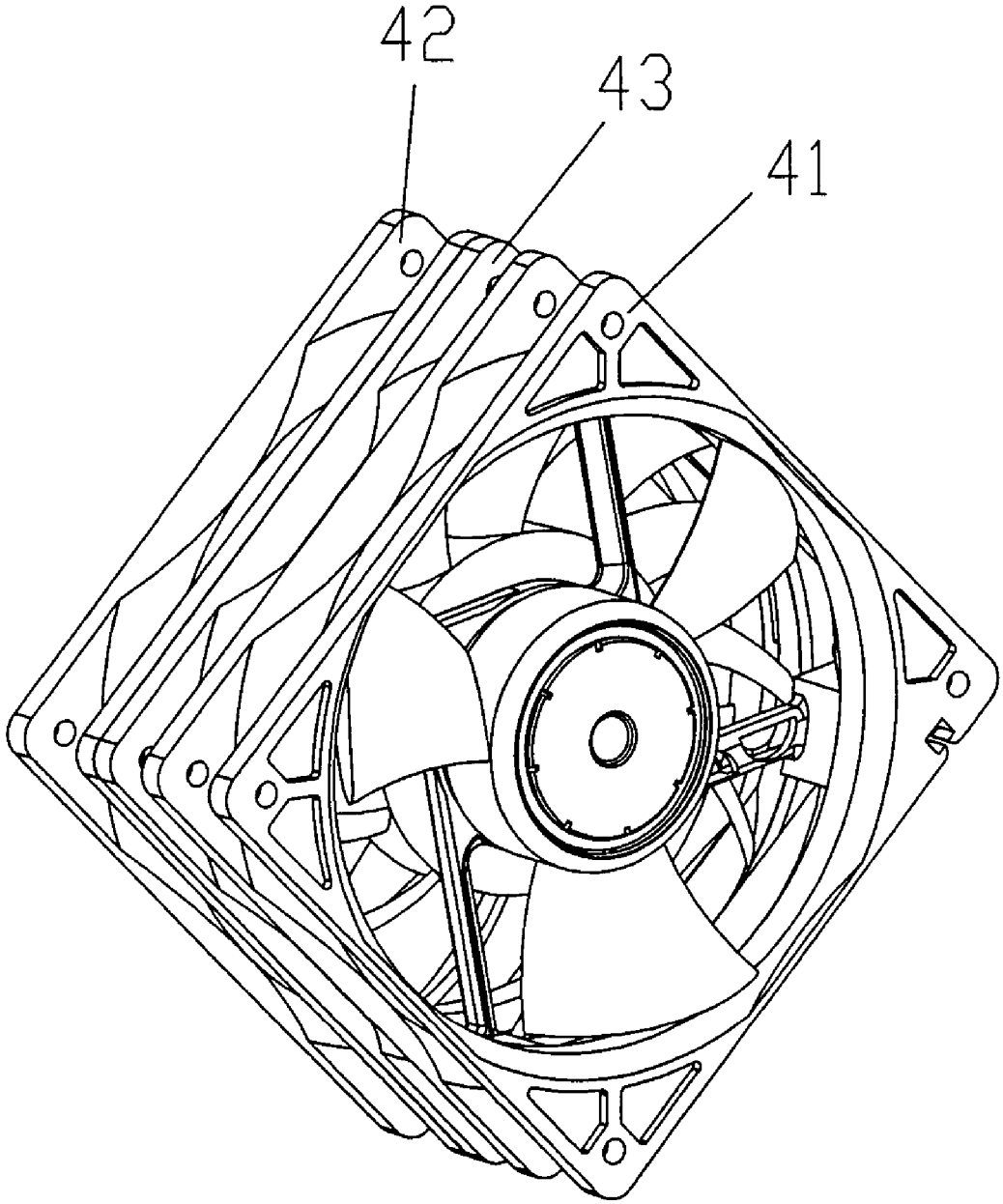
FIG. 4B is a perspective diagram of the assembled composite heat-dissipating system of FIG. 4A.
Figure 5:
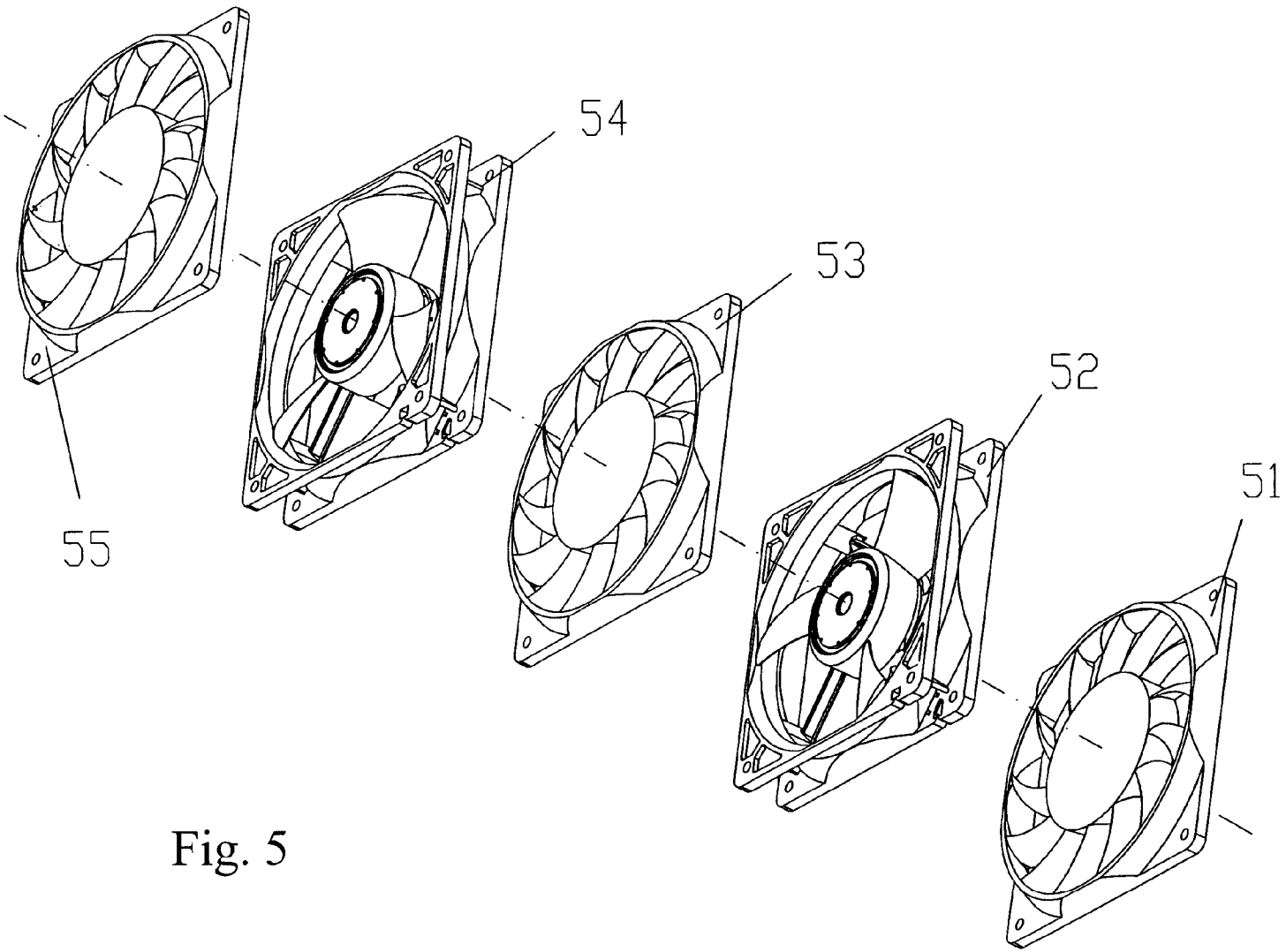
FIG. 5 is an exploded diagram showing a second preferred embodiment of a composite heat-dissipating system according to the present invention.
Figure 6:
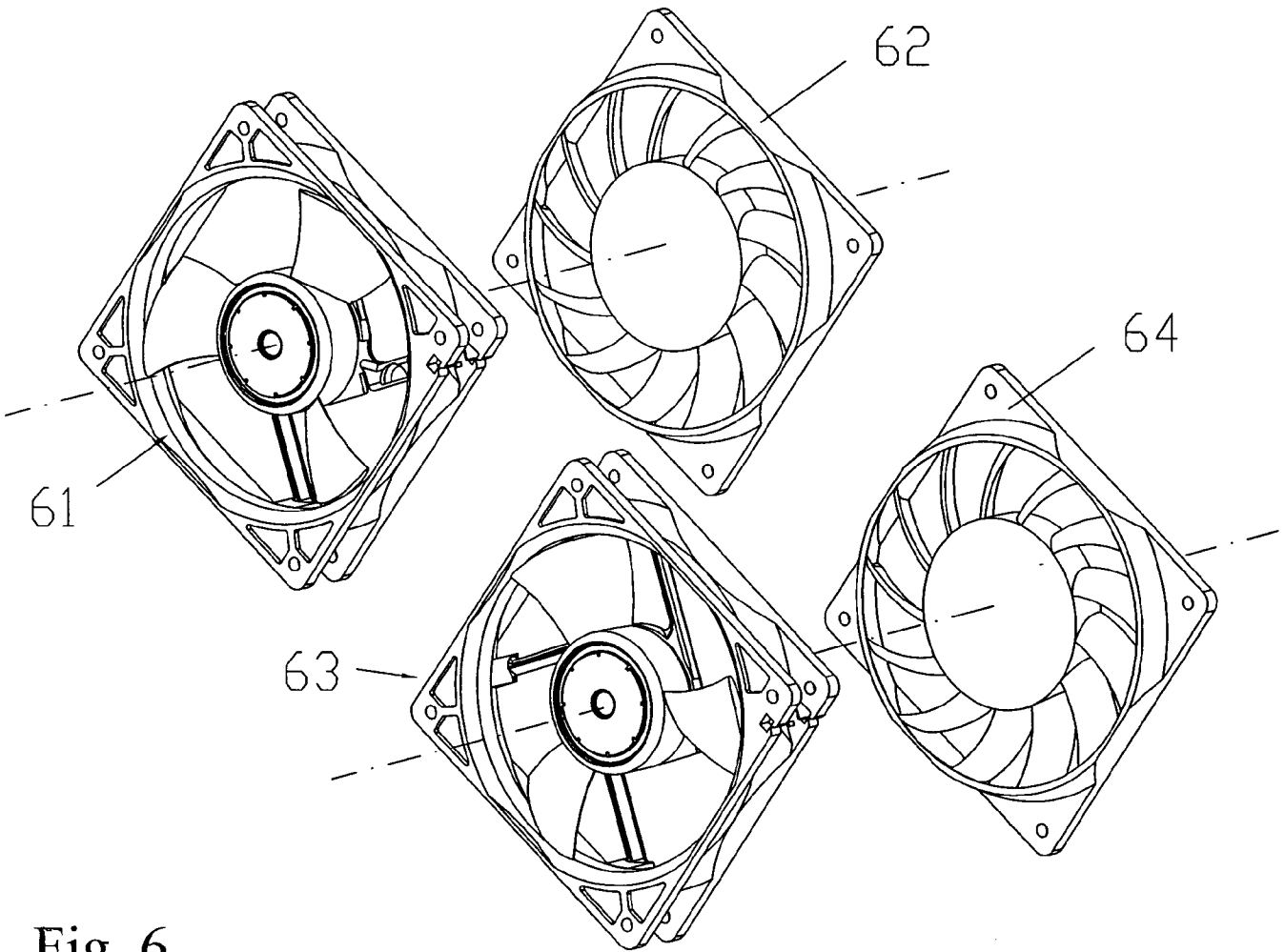
FIG. 6 is an exploded diagram showing a third preferred embodiment of a composite heat-dissipating system according to the present invention.

Please now refer to FIGS. 4~6 which schematically show several kinds of composite heat-dissipating systems which respectively include at least one fan guard and the heat-dissipating devices to further enhance heat-dissipating efficiency.

The composite heat-dissipating system shown in FIG. 4A or FIG. 4B is assembled by screwing the frames of the heat-dissipating devices 41, 42 and the frame of the fan guard 43 together so that the guard blades of the fan guard is disposed upstream of the rotor blades of the heat-dissipating device 41 and downstream of the heat-dissipating device 42 to simultaneously enhance the efficiencies of the heat-dissipating device 41 and the heat-dissipating device 42 so as to supercharge the composite heat-dissipating system.

FIG. 5 schematically shows another embodiment of composite heat-dissipating system according to the present invention. In this embodiment, there are the first fan guard 51 located upstream of the heat-dissipating device 52, the second fan guard 53 located between the heat-dissipating devices 52, 54, and the third fan guard 55 located downstream of the heat-dissipating device 54, that is, the first, second and third fan guards 51, 53, 55 and the heat-dissipating devices 52, 54 are connected in series to both enhance the heat-dissipating efficiency of the composite heat-dissipating system. By this way, the composite heat-dissipating system is supercharged.

A further embodiment of a composite heat-dissipating system is shown on FIG. 6 wherein one heat-dissipating device 61 and one fan guard 62 are assembled in series to construct the first set of heat-dissipating device; likewise, another heat-dissipating device 63 and another one fan guard 64 are assembled in series to construct the second set of heat-dissipating device. Finally, the first set of heat-dissipating device and the second set of heat-dissipating device are combined in parallel together to form the composite heat-dissipating system.

Figure 7:
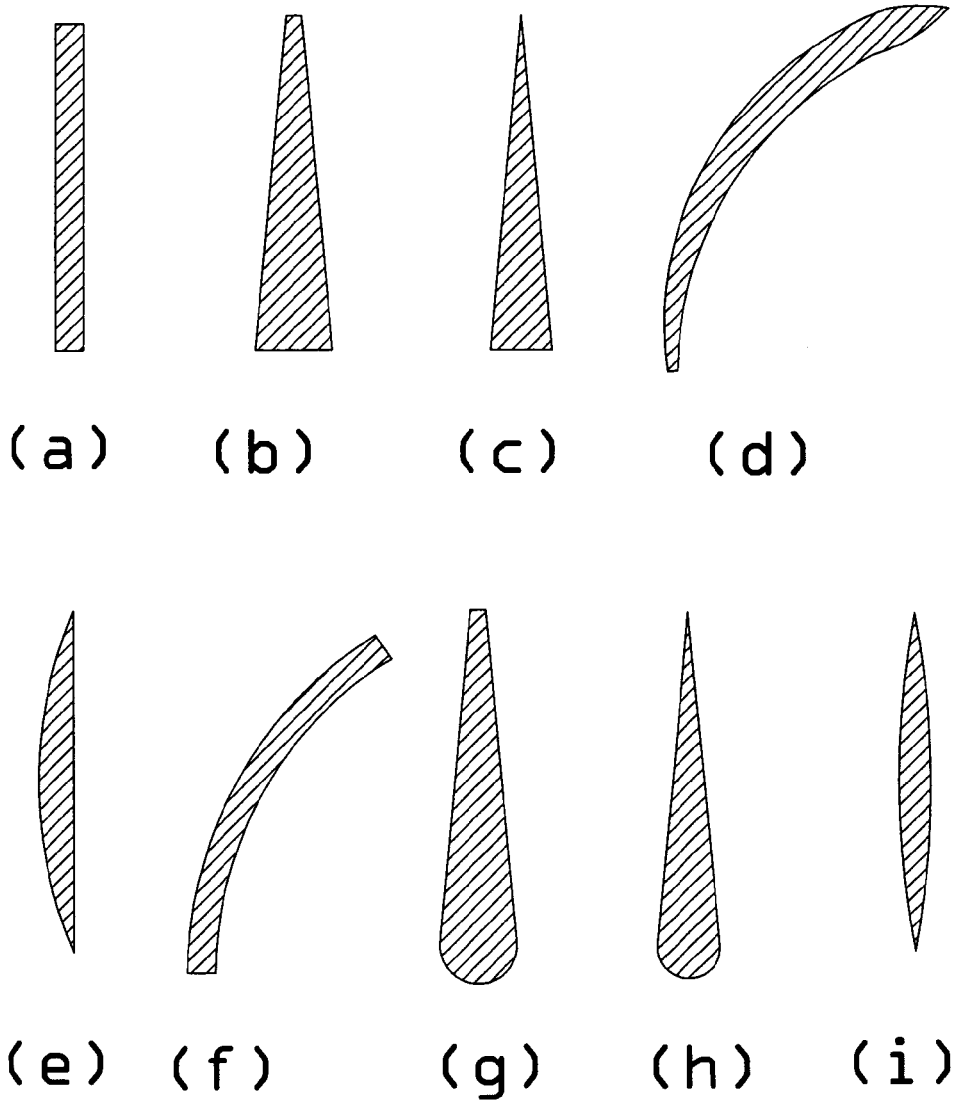
FIGS. 7(*a*)~7(*i*) are sectional diagrams of another embodiments of the respective guard blade of the fan guard according to the present invention.

Although the guard blades in the above embodiments are exemplified to have shapes substantially identical to those of the rotor blades of the heat-dissipating device, they can be formed as plane plates or any other suitable shapes as long as the efficiency of the fan can be enhanced thereby. Please refer to FIGS. 7(*a*)~7(*i*) which are sectional diagrams of a variety of the guard blades of the fan guard according to the present invention. Each of guard blades has a cross-sectional shape selected from a group essentially consisting of plate, triangle, trapezoid and wing, or has a curved face, an arcuate face, curve or arc, prefereably a cross-sectional shape with a linear central line and a curve or an arc line. In addition, the number of the guard blades need not be particularly limited. The guard blades can be made of plastic. Nevertheless, the guard blades can also be made of a material other than plastic for a desired purpose. For example, when they are made of metal, the guard blades can serve as efficient heat-dissipating plates to further enhance the heat-dissipating efficiency. The fan guard can be assembled with the main frame of the heat-dissipating device through screws, rivets, adhesives or engaging members. Alternatively, the fan guard can be integrally formed with the system frame in which the heat-dissipating device is disposed, or integrally formed with the main frame of the heat-dissipating device.

Figure 8:
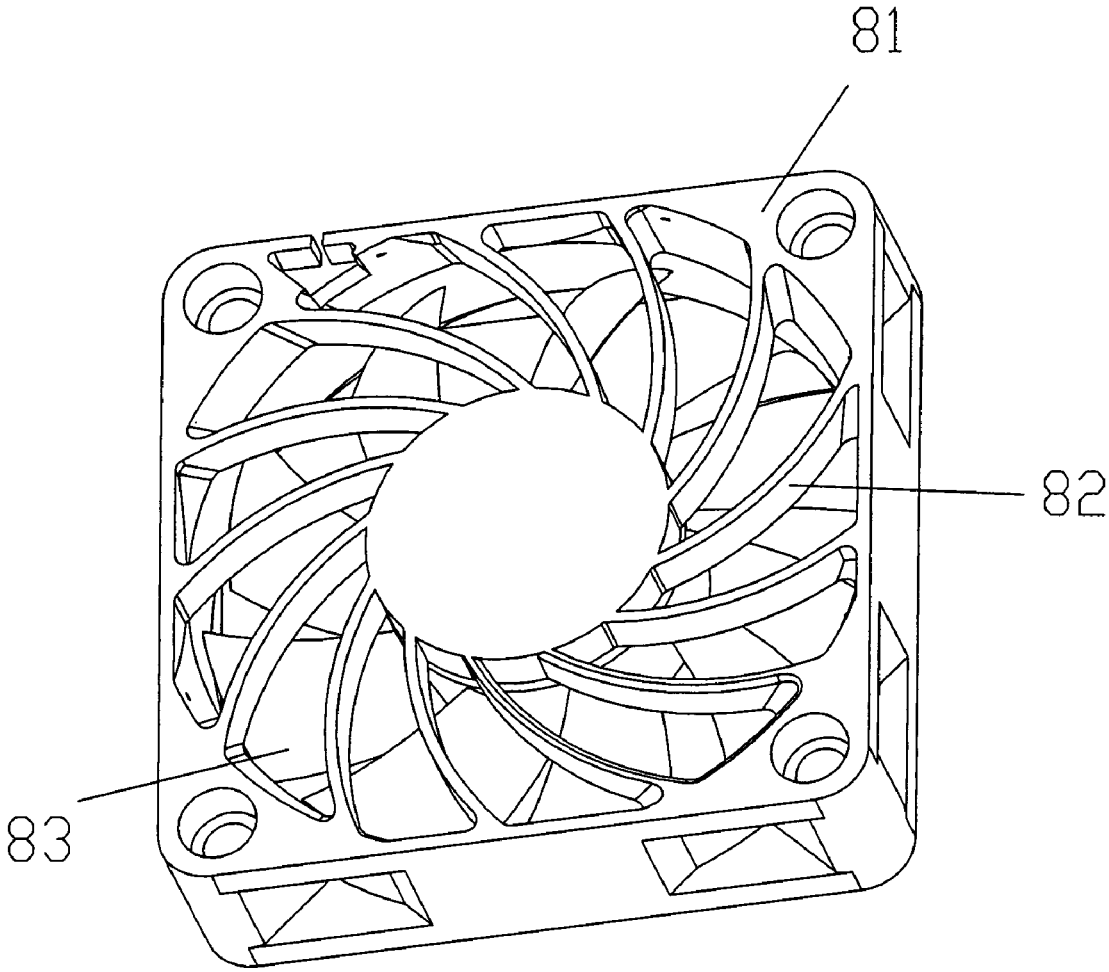
FIG. 8 is a perspective diagram of a preferred embodiment of the heat-dissipating device to be used with the fan guard of the present invention.
Figure 9:
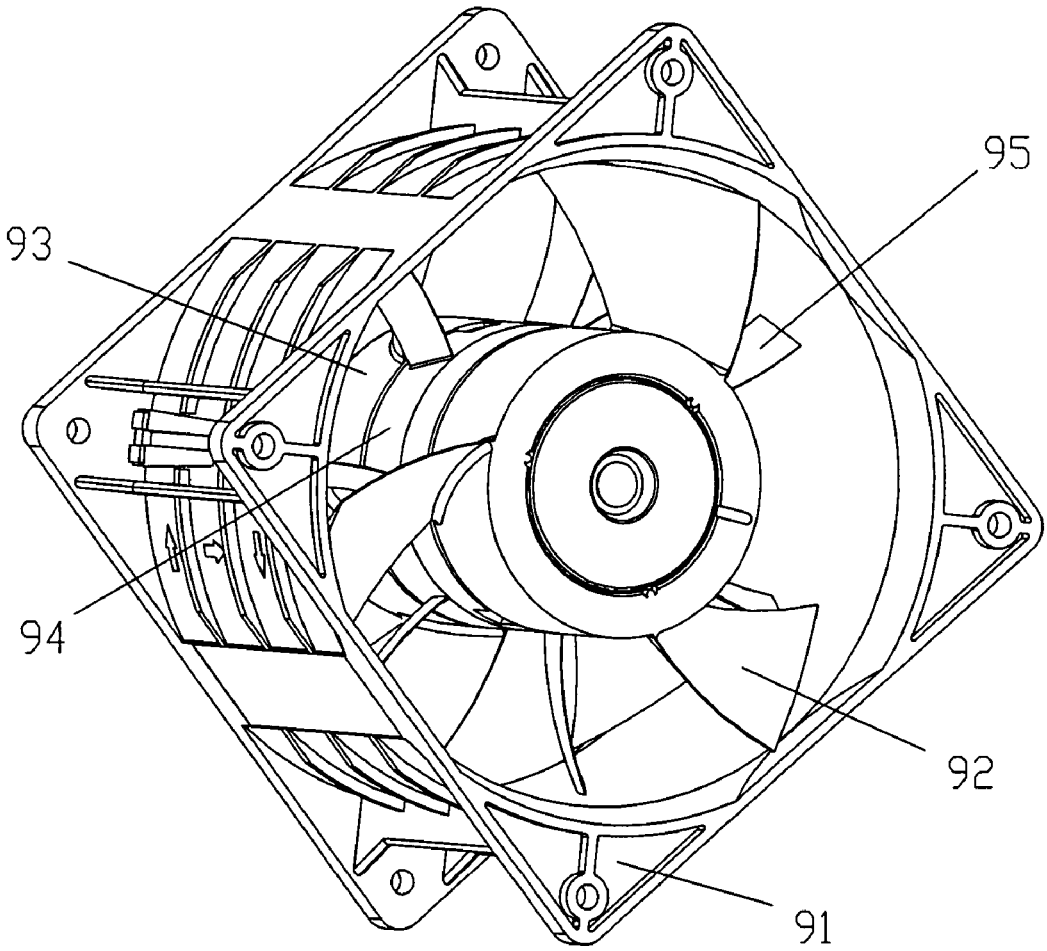
FIG. 9 is a perspective diagram of another preferred embodiment of the heat-dissipating device to be used with the fan guard of the present invention.
Figure 10:
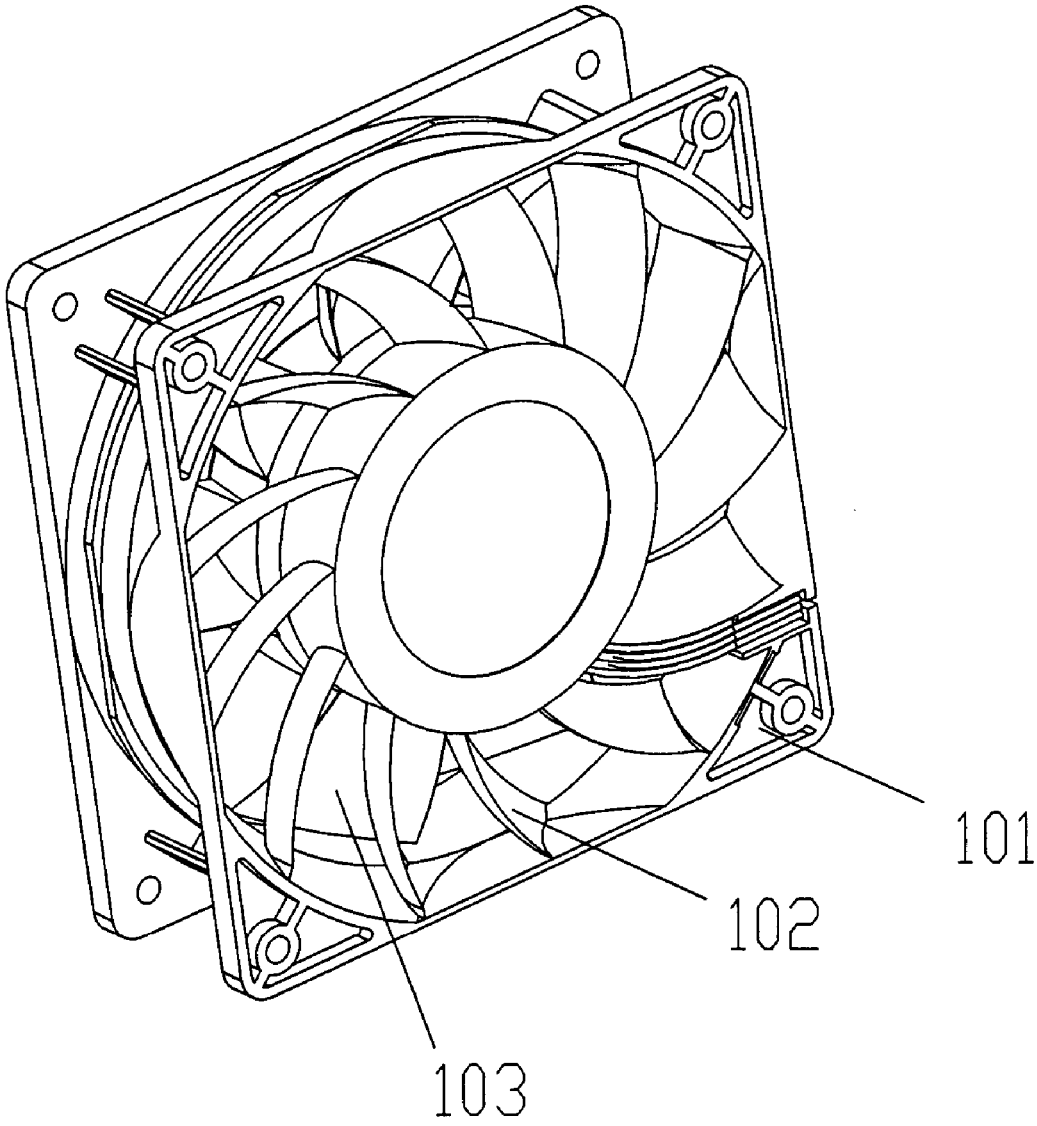
FIG. 10 is a perspective diagram of further another preferred embodiment of the heat-dissipating device to be used with the fan guard of the present invention.

In addition to the heat-dissipating devices shown in FIGS. 3~6, other kind of the heat-dissipating devices as shown in FIGS. 8~10 can also be used with the fan guard of the present invention to further enhance the heat-dissipating efficiency. The heat-dissipating device shown in FIG. 8 includes a main frame 81, a plurality of guard blades 82 radially arranged inside the main frame 81 and fixed onto an inner surface of the main frame by each one end thereof, and a rotor device including a motor received in the motor holder of the main frame, and a plurality of rotor blades 83 working on the surrounding air to generate airflow. After the fan guard is located upstream or downstream of such a heat-dissipating device, the airflow discharged from the air outlet side of the heat-dissipating device can be further supercharged. Similarly, the heat-dissipating device can be designed as that shown in FIG. 9, which includes a main frame 91, two rotor devices 92, 93 connected in series in the axial direction, a support 94 connected with the frame through a plurality of guard blades 95 for supporting the two rotor devices. Alternatively, the heat-dissipating device can be designed as that shown in FIG. 10, which includes a main frame 101, a motor holder substantially located at the center of the main frame, a plurality of guard blades 102 vortically arranged between the main frame and the motor holder, and a rotor device including a motor received in the motor holder, a shaft ring connected to and driven by the motor to revolve, and a plurality of rotor blades 103 fixed on the circumferential surface of the shaft ring and revolving with the shaft ring to work on the surrounding air to generate airflow.

To sum up, the fan guard of the present invention can be used with different kind of heat-dissipating fans so that the airflow out of the fan can be supercharged, no matter where the fan guard is located upstream or downstream of the fan. In addition, after each pair of the fan guard and the heat-dissipating fan is connected in series, one pair of the fan guard and the heat-dissipating fan can be assembled with other pairs of the fan guard and the heat-dissipating fan in series or in parallel. Therefore, the fan guard of the present invention can effectively eliminate the interference between the heat-dissipating devices assembled together, provide a supercharging function, and reduce the noise generated when the heat-dissipating devices are operated.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fan guard adapted to be used with at least one heat-dissipating device with a plurality of rotor blades for supercharging an airflow discharging from said heat-dissipating device, comprising:

a frame integrally formed with a main frame of said heat-dissipating device; and a set of guard blades arranged inside said frame, wherein said guard blades are arranged relative to said rotor blades to supercharge an airflow out of said heat-dissipating.

2. The fan guard according to claim 1, wherein said fan guard is disposed on an airflow outlet side of said heat-dissipating device.

3. The fan guard according to claim 1, wherein said fan guard is disposed on an airflow inlet side of said heat-dissipating device.

4. The fan guard according to claim 3, further comprising another frame and another set of guard blades to be disposed on an airflow outlet side of said heat-dissipating device.

5. The fan guard according to claim 1, wherein said fan guard is disposed on a system frame in which said heat-dissipating device is disposed.

6. The fan guard according to claim 1, wherein each of said guard blades has a cross-sectional shape selected from a group essentially consisting of plate, triangle, trapezoid and wing.

7. The fan guard according to claim 1, wherein each of said guard blades has at least one selected from a group essentially consisting of a curved face, an arcuate face, a curve and an arc.

8. The fan guard according to claim 1, wherein each of said guard blades has a cross section with a linear central line and one of a curved or an arced profile.

9. The fan guard according to claim 1, wherein each of said guard blades has a shape substantially similar to those of said rotor blades.

10. The fan guard according to claim 1, wherein said guard blades are integrally formed with said frame.

11. A heat-dissipating device comprising:

a main frame;

a rotor device having a plurality of rotor blades; and a fan guard coupled to said rotor device and having a frame and a plurality of guard blades arranged inside said frame;

wherein said guard blades are arranged relative to said rotor blades to supercharge an airflow out of said heat-dissipating device, and said frame of said fan guard is integrally formed with said main frame.

12. The heat-dissipating device according to claim 11, wherein said guard blades are arranged upstream of said rotor blades of said rotor device.

13. The heat-dissipating device according to claim 11, wherein said guard blades are arranged downstream of said rotor blades of said rotor device.

14. A composite heat-dissipating system comprising:

at least one fan guard respectively having a frame and a set of guard blades arranged inside said frame; and at least one heat-dissipating device respectively having a first rotor device with a plurality of rotor blades;

wherein said guard blades are arranged relative to said rotor blades of said at least one heat-dissipating device to supercharge an airflow out of said at least one heat-dissipating device, and said frame of said fan guard and a main frame of said at least one heat-dissipating device are integrally formed together.

15. The composite heat-dissipating system according to claim 14, wherein each of said guard blades has a shape substantially similar to those of said rotor blades of said at least one heat-dissipating device.

16. The composite heat-dissipating system according to claim 14, wherein said at least one fan guard is arranged upstream of said rotor blades of said at least one heat-dissipating device.

17. The composite heat-dissipating system according to claim 14, wherein said at least one fan guard is arranged downstream of said rotor blades of said at least one heat-dissipating device.

18. The composite heat-dissipating system according to claim 14, wherein said at least one fan guard is arranged between any two of said least one heat-dissipating device.

19. A composite heat-dissipating system comprising:

at least one fan guard respectively having a frame and a set of guard blades arranged inside said frame; and at least one heat-dissipating device respectively having a first rotor device with a plurality of rotor blades, a main frame surrounding said first rotor device, and a plurality of guard blades radially arranged inside said main frame;

wherein said guard blades are arranged relative to said rotor blades of said at least one heat-dissipating device to supercharge an airflow out of said at least one heat-dissipating device, each of said guard blades of said at least one heat-dissipating device has a shape substantially similar to those of said rotor blades and an arrangement relative to said rotor blades for allowing a tangential velocity of an air outflow from said heat-dissipating device to be transformed into a static pressure.

20. A composite heat-dissipating system comprising:

at least one fan guard respectively having a frame and a set of guard blades arranged inside said frame; and at least one heat-dissipating device respectively having a first rotor device with a plurality of rotor blades, a main frame, a second rotor device with a plurality of rotor blades, and a support mounted within said main frame for supporting said first and second rotor devices;

wherein said guard blades are arranged relative to said rotor blades of said at least one heat-dissipating device to supercharge an airflow out of said at least one heat-dissipating device, and said first and second rotor devices are connected in series in the axial direction.

21. A composite heat-dissipating system comprising:

at least one fan guard respectively having a frame and a set of guard blades arranged inside said frame; and at least one heat-dissipating device respectively having a first rotor device with a plurality of rotor blades;

wherein said guard blades are arranged relative to said rotor blades of said at least one heat-dissipating device to supercharge an airflow out of said at least one heat-dissipating device, one pair of said at least one fan guard and said at least one heat-dissipating device are connected in series and assembled with another pair of said at least one fan guard and said at least one heat-dissipating device in parallel.

* * * * *